US007794203B2

(12) United States Patent
Drelon et al.

(10) Patent No.: US 7,794,203 B2
(45) Date of Patent: Sep. 14, 2010

(54) JOINING DEVICE FOR JOINING TWO ASSEMBLIES, FOR EXAMPLE FOR A STATOR OF A TURBOMACHINE

(75) Inventors: Godefroy Francis Frederic Drelon, Blandy les Tours (FR); Philippe Jean-Pierre Pabion, Vaux le Penil (FR); Sebastien Jean Laurent Prestel, Arpajon (FR); Jean-Luc Soupizon, Vaux le Penil (FR)

(73) Assignee: Snecma, Paris (FR)

( * ) Notice: Subject to any disclaimer, the term of this patent is extended or adjusted under 35 U.S.C. 154(b) by 143 days.

(21) Appl. No.: 12/017,486

(22) Filed: Jan. 22, 2008

(65) Prior Publication Data

US 2008/0240845 A1 Oct. 2, 2008

(30) Foreign Application Priority Data

Jan. 26, 2007 (FR) ..... 07 52894

(51) Int. Cl.
*F04D 29/44* (2006.01)

(52) U.S. Cl. ..... 415/209.4; 415/142; 403/154; 403/157

(58) Field of Classification Search ..... 403/335, 403/336, 337, 364, 67, 79, 150, 154, 157; 60/805; 415/136, 138, 142, 209.2, 209.3, 415/209.4, 214.1

See application file for complete search history.

(56) References Cited

U.S. PATENT DOCUMENTS

| | | | | |
|---|---|---|---|---|
| 4,688,378 | A * | 8/1987 | Harris | 415/138 |
| 5,024,283 | A * | 6/1991 | Deli | 403/79 |
| 5,211,536 | A * | 5/1993 | Ackerman et al. | 415/209.3 |
| 5,839,878 | A * | 11/1998 | Maier | 415/209.2 |
| 5,848,874 | A | 12/1998 | Heumann et al. | |
| 6,742,987 | B2 * | 6/2004 | Correia et al. | 415/209.4 |
| 7,063,505 | B2 * | 6/2006 | Czachor | 415/209.4 |
| 7,101,150 | B2 * | 9/2006 | Bash et al. | 415/209.3 |

* cited by examiner

*Primary Examiner*—Michael P Ferguson
(74) *Attorney, Agent, or Firm*—Oblon, Spivak, McClelland, Maier & Neustadt, L.L.P.

(57) ABSTRACT

A joining device including a clevis and a connecting member is disclosed. The connecting member includes a through hole which is housed between a first and a second lug of the clevis. These lugs respectively have a first clevis hole and a second clevis hole. The device further includes a shear pin system passing through each of the holes and includes a threaded end collaborating with a nut system which abuts against the second lug. The shear pin system includes a widened portion passing through the first hole and forming a shoulder situated between the two lugs. The member is situated away from the first lug. A first side of the member is pressed against the shoulder and a second side of the member is pressed against the second lug.

11 Claims, 3 Drawing Sheets

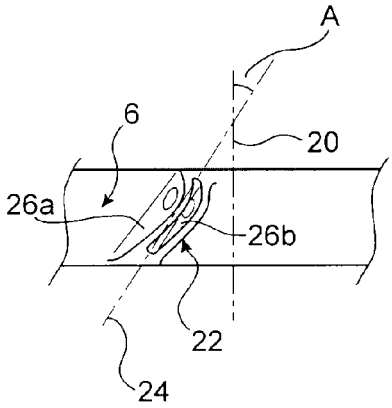
FIG.2a
FIG.3
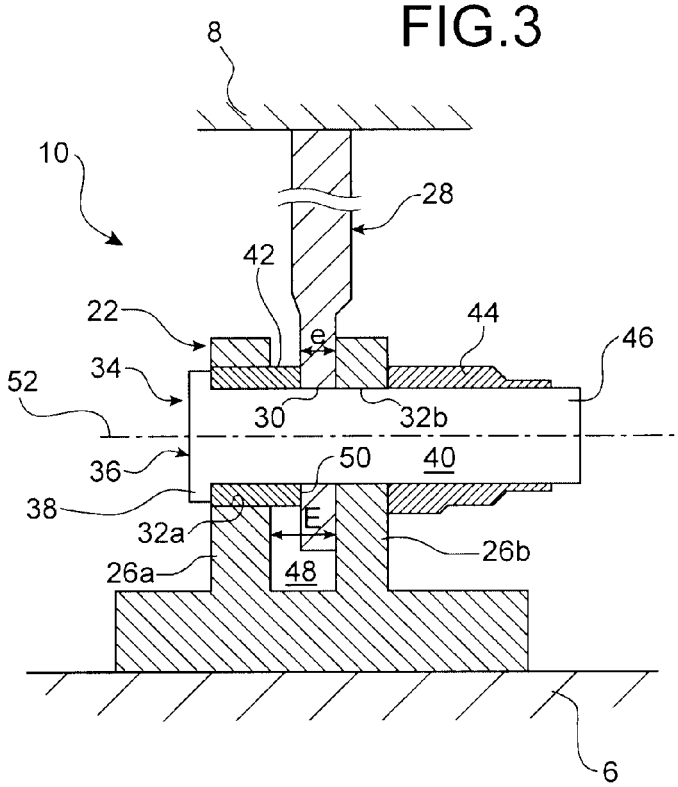
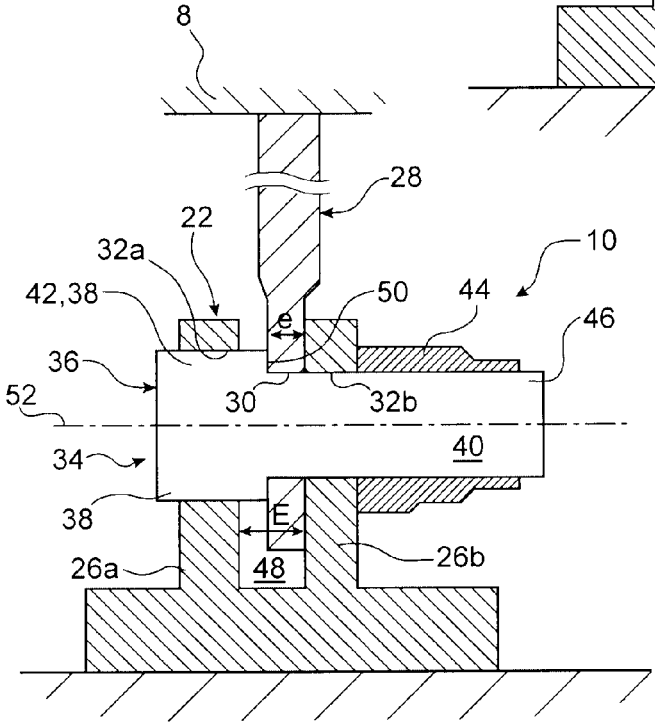
FIG.4

JOINING DEVICE FOR JOINING TWO ASSEMBLIES, FOR EXAMPLE FOR A STATOR OF A TURBOMACHINE

TECHNICAL FIELD

The present invention relates in general to a joining device for joining two assemblies of the type comprising a clevis intended to be attached to a first assembly and a connecting member intended to be attached to a second assembly.

The invention applies particularly although not exclusively to the field of turbomachines, preferably taking the form of a turbojet engine for an aircraft, for example for connecting together two annular and concentric assemblies of a turbine or compressor stator.

PRIOR ART

Various joining devices of the type mentioned hereinabove are known from the prior art.

First, a conventional device known as a two-lug clevis is known. This is used to clamp the connecting member between the two lugs using a screw/nut combination passing through the device. In this case, loads are transferred essentially by the rubbing of the two opposing faces of the connecting member against the respective internal faces of the two lugs between which this same member is gripped.

The disadvantage of this kind of set up lies in the fact that it is conceivable only with a very small amount of clearance between the various components before the screw/nut assembly is tightened. This is because an excessive initial separation between the lugs of the clevis would, upon tightening, squeeze these lugs together and stress them, thereby weakening them.

Furthermore, with this combination, it is only possible to bring the connecting member parallel to the lugs of the clevis as it is being introduced between these lugs, namely at right angles to the axes of the clevis holes, by applying a translational movement parallel to a direction known as the clevis orientation direction. This inevitably makes it difficult, if not impossible, under certain circumstances as described in the example below, for an operator to assemble and of necessity entails that the components be positioned very accurately relative to one another in order to be able to achieve the aforementioned introduction.

In effect, it is possible to envision a scenario in which the first annular assembly is positioned radially on the inside with respect to the second annular assembly, with the clevis of each of the joining devices with which this first annular assembly is equipped being arranged in such a way that, when viewed from above with respect to this clevis, the clevis is set at the same angle with respect to an axis of the first and second annular assemblies. In this configuration, it is evidently impossible to introduce each of the connecting members which are distributed circumferentially on the second assembly simultaneously into their associated clevis and this is true regardless of the nature of the relative movement applied to the first and second assemblies.

The prior art also discloses a conventional device also known as a two-lug clevis device but in which the connecting member is not clamped between the two lugs but separated therefrom. In this case, the loadings are then transferred through the shearing and bending of the pin system that passes through the various components of the joining device. Nonetheless, the major disadvantage with this type of setup stems from there being a degree of freedom associated with the connecting member situated some distance from the two clevis lugs, giving this same member the ability to move along the pin system. As a result, because this connecting member is not pressed against the clevis lugs, it is therefore impossible to guarantee accurate positioning of the second assembly with respect to the first assembly.

In addition, if a clearance is left between the pin system and the through hole made in the connecting member, particularly with a view to accommodating some degree of uncertainty over the positioning prior to the introduction of the pin system through this hole, the mechanical joint obtained then becomes extremely sensitive to vibrations.

Finally, the prior art also discloses another conventional device known as a single lug clevis, in which the connecting member is clamped against the single lug of the clevis. This configuration does of course have the advantage of introducing practically no accessibility constraints on the operator who has to bring the member onto the single lug. In other words, in contrast with the previous embodiments, the member can be fitted onto the clevis in some way other than by applying a translational movement parallel to orientation of the clevis, thus offering the operator more scope.

However, the lug and the member experience a significant amount of bending as a result of the asymmetry of the fastening, thus creating a high bending moment. In addition, in order to transmit loads of the same order of magnitude, this type of fastening requires components which are overengineered by comparison with those of which the abovementioned two-lug clevis devices are made, and as a result causes problems of space.

SUMMARY OF THE INVENTION

It is therefore an object of the invention to propose a joining device that at least partially remedies the aforementioned disadvantages relating to the embodiments of the prior art.

To do this, a first subject of the invention is a joining device for joining two assemblies comprising a clevis intended to be attached to a first assembly and a connecting member intended to be attached to a second assembly, the connecting member pierced with a through hole being housed between a first and a second lug of the clevis, these lugs respectively having a first clevis hole and a second clevis hole, the device further comprising a shear pin system passing through each of the first clevis hole, second clevis hole and through hole and comprising a threaded end collaborating with a nut system bearing against a second clevis lug.

According to the invention, the shear pin system comprises, at the opposite end to the threaded end, a widened portion passing through the first clevis hole and forming a shoulder situated between the first and second clevis lugs, the connecting member situated some distance from the first clevis lug being pressed, on one side, against the shoulder and, on the other side, against the second clevis lug.

The joining device according to the invention has the particular feature of enjoying all of the advantages relating to the embodiments of the prior art, without suffering from their disadvantages.

Specifically, it should first of all be emphasized that the joining device is of a design which allows it to be made of small-sized elements, in that the presence of a two-lug clevis avoids the detrimental bending effects encountered in the single-lug solutions of the prior art.

In addition, it is advantageously possible to achieve accurate final positioning of the connecting member with respect to the clevis given that this member is kept fixedly in contact with one of the two lugs of this clevis. As a result, this makes it possible to obtain very precise relative positioning between the first and second assemblies bearing this joining device according to the invention.

Furthermore, even if some clearance is preferentially left between the shear pin system and the through hole made in the connecting member, particularly with a view to accommodating some uncertainty over the positioning prior to the introduction of the shear pin system through this hole, the mechanical connection remains advantageously insensitive to vibrations insofar as the connecting member is held fixedly by friction between the shoulder of the shear pin system and one of the two lugs.

Finally, it must therefore be understood that the separation between the two lugs is far greater than the thickness of the connecting member because this connecting member is situated some distance from the first clevis lug in the assembled position. Thus, this particular feature offers the advantage of giving the operator a great deal of scope as to how he introduces the member into the clevis, this insertion of course now no longer being restricted to the application of a translational movement parallel to the orientation of the clevis as it was before.

By way of indicative example, the invention applies to a case in which the first annular assembly is positioned radially on the inside with respect to the second annular assembly on which it is fixedly mounted using several circumferentially distributed joining devices, with the clevis of each of these devices with which the first assembly is equipped positioned in such a way that, when viewed from above with respect to this clevis, the clevis is set at the same angle with respect to an axis of the first and second annular assemblies. In this configuration which is, for example, encountered on a turbomachine stator, simultaneous introduction of each of the connecting members into their associated clevis becomes possible simply by applying to the first and/or second assemblies a relative movement of the twisting type about the axis of these assemblies.

By way of example, the thickness (e) of the connecting member in one direction of the shear pin system satisfies the condition $1.3<E/e<2.5$ where (E) corresponds to a separation between the first and second clevis lugs in the same direction. Naturally, this ratio can be altered by those skilled in the art to suit the requirements encountered. In particular, in the preferred case indicated hereinabove in which each of the connecting members is to be introduced simultaneously into its associated clevis by applying to the first and/or second assembly a relative movement of the twisting type about the axis of these assemblies, the ratio E/e that allows such "screw-fastening" may then be set according to various parameters such as the magnitude of the angle at which the lugs are set, their height and thickness, the radius of the first assembly bearing the clevises, etc.

In other words, it was mentioned that the invention can be applied wherever the assembly movement requires a clearance which is greater, even if only very slightly, than the mere clearance associated with manufacturing tolerances. For example, if the setting angle is very small, of the order of 5°, then the ratio E/e may possibly be less than 1.3 but the assembly movement will nonetheless need to be a twisting movement, namely a movement of the type mentioned hereinabove.

According to a first preferred embodiment of the present invention, the shear pin system comprises a head and a bushing bearing at one of its ends against the head, the bushing constituting the widened portion passing through the first clevis hole and forming the shoulder at the other of its ends. In such a scenario, provision is therefore made for the diameter of the screw head to be smaller than or equal to the outside diameter of the bushing, which for its own part corresponds more or less to the diameter of the first clevis hole. Nonetheless, when the screw head is entirely externally offset with respect to the clevis, that is to say is not in any way in contact therewith, it may have a diameter greater than the outside diameter of the bushing, and therefore greater than the diameter of the first clevis hole, without departing from the scope of the invention.

According to a second preferred embodiment of the present invention the shear pin system is in the form of a pin made as a single piece, having a head that constitutes the widened portion passing through the first clevis hole. In this second embodiment, it is therefore the screw head which passes right through the first clevis hole and which forms the shoulder against which the connecting member is clamped at its end bearing the threaded part.

In these two preferred embodiments, arrangements are preferably made to ensure that the shear pin system does not butt against the first clevis lug, in order to be certain of obtaining contact between the shoulder and the connecting member.

As a preference, in order to ensure ease of fitting, provision is made for the first clevis hole to be larger than the second clevis hole.

Finally, it must be noted that the connecting member may be in the form of an arm.

Furthermore, a further subject of the invention is, a joint for a turbomachine comprising first and second assemblies fixedly attached to one another by at least one joining device as described hereinabove. More preferably, the first and second assemblies are annular and concentric and attached fixedly to one another by a number of joining devices as described hereinabove, spaced circumferentially apart, preferably uniformly.

As mentioned hereinabove, provision may then be made for the first annular assembly to be positioned radially on the inside with respect to the second annular assembly, and for the clevis of each of the joining devices with which the first annular assembly is equipped to be arranged in such a way that, when viewed from above with respect to this clevis, it has its clevis set at the same angle with respect to an axis of the first and second annular assemblies. Thus, it is then possible to conceive of introducing each of the connecting members into their associated clevis simultaneously by applying to the first and/or second assembly a relative movement of twisting type about the axis of these assemblies, as indicated earlier.

As a preference, the first and second assemblies between them define an annular space that forms a portion of a primary duct for the gases of the turbomachine.

Again as a preference, the joint constitutes a portion of a stator of the turbomachine.

Furthermore, a further subject of the invention is a turbomachine module comprising at least one joint as set out hereinabove.

As a preference, the module is a high-pressure or low-pressure turbomachine turbine or compressor.

Finally, a further subject of the invention is a turbomachine such as an aircraft turbojet engine comprising at least one module like the one described hereinabove.

Other advantages and features of the invention will become apparent from the nonlimiting detailed description given below.

BRIEF DESCRIPTION OF THE DRAWINGS

This description will be given with reference to the attached drawings in which:

FIG. 2*a* depicts a schematic part view from above of the first annular assembly belonging to the stator joint shown in FIG. 2;

FIG. 3 shows a view in section on III-III of FIG. 2, and depicting a joining device according to a first preferred embodiment of the present invention; and FIG. 4 shows a view similar to that of FIG. 3 in which the joining device is in the form of a second preferred embodiment of the present invention.

DETAILED DESCRIPTION OF THE PREFERRED EMBODIMENTS

Figure 1:
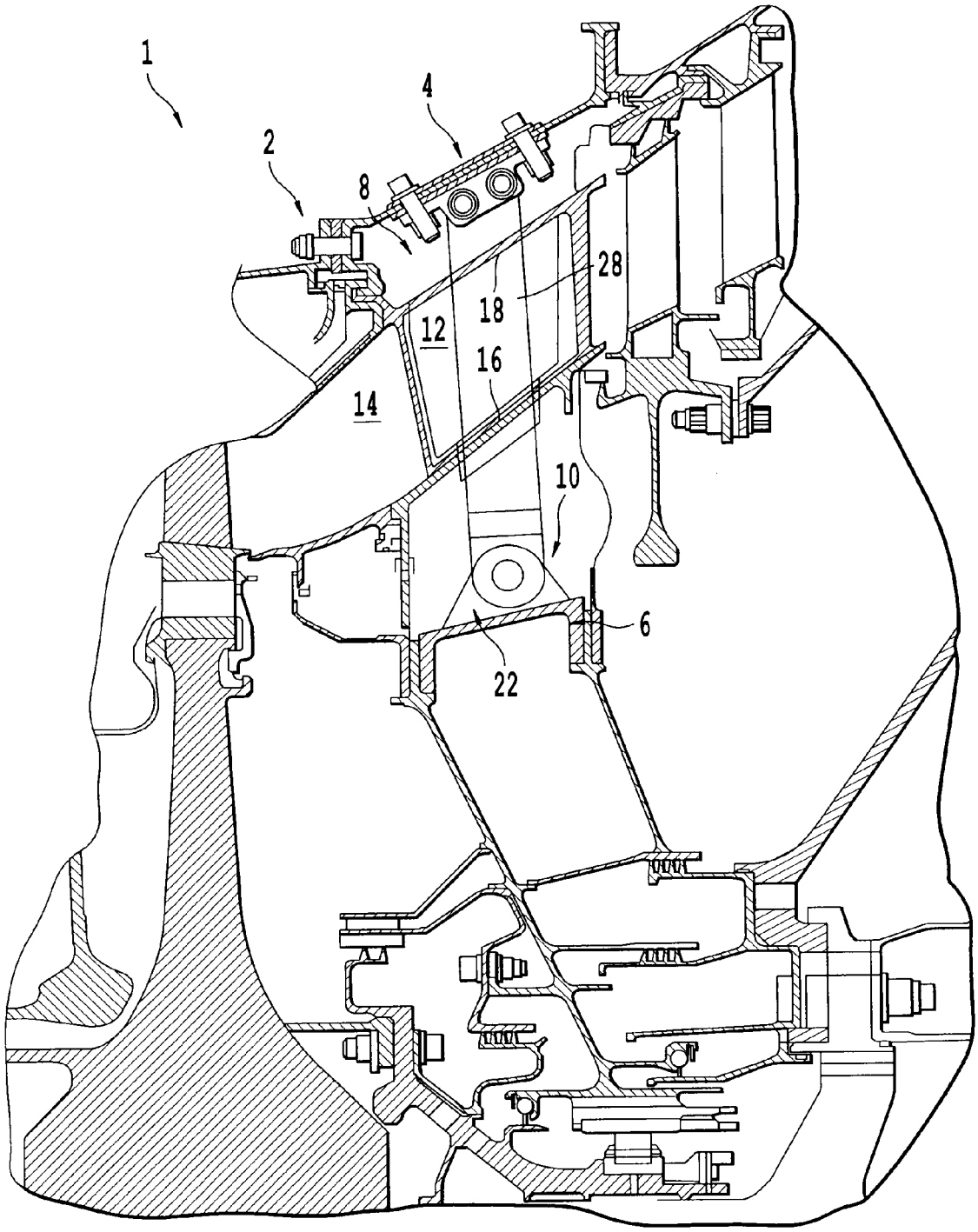
FIG. 1 depicts a sectional part view of a turbomachine according to one preferred embodiment of the present invention.

FIG. 1 shows part of a turbomachine 1 according to one preferred embodiment of the present invention and, more particularly, a turbomachine module 2 which in this instance is a high-pressure or HP turbine of the turbomachine, which for its part is in the form of an aircraft turbojet engine.

The module 2 comprises a stator partially composed of a joint 4 which also forms part of the subject of the present invention, this joint 4 in general comprising a first assembly 6 and a second assembly 8 which are annular and concentric about an axis of the turbomachine (not depicted) which also corresponds to the axis of these assemblies 6, 8. As will be detailed hereinbelow, the assemblies 6, 8 are fixedly attached to one another by a number of joining devices 10 spaced circumferentially apart, uniformly, also termed as "cyclically".

As is visible in FIG. 1, the first and second assemblies 6, 8 between them define an annular space 12 forming a transverse portion of the primary duct for the gases 14 of the turbomachine. In other words, the gases escaping from the combustion chamber (not depicted) of the turbomachine travel along the annular primary gas duct 14 partially defined between the annular assemblies 6 and 8, causing them to flow through the annular space 12 of the stator joint 4 toward the downstream end of the turbomachine. The annular space 12 that forms a transverse portion of the primary duct for the gases 14 could be directly radially delimited not by the two assemblies 6, 8 but by inner and outer annular covers 16, 18 attached fixedly to these same assemblies respectively, between said assemblies.

Figure 2:
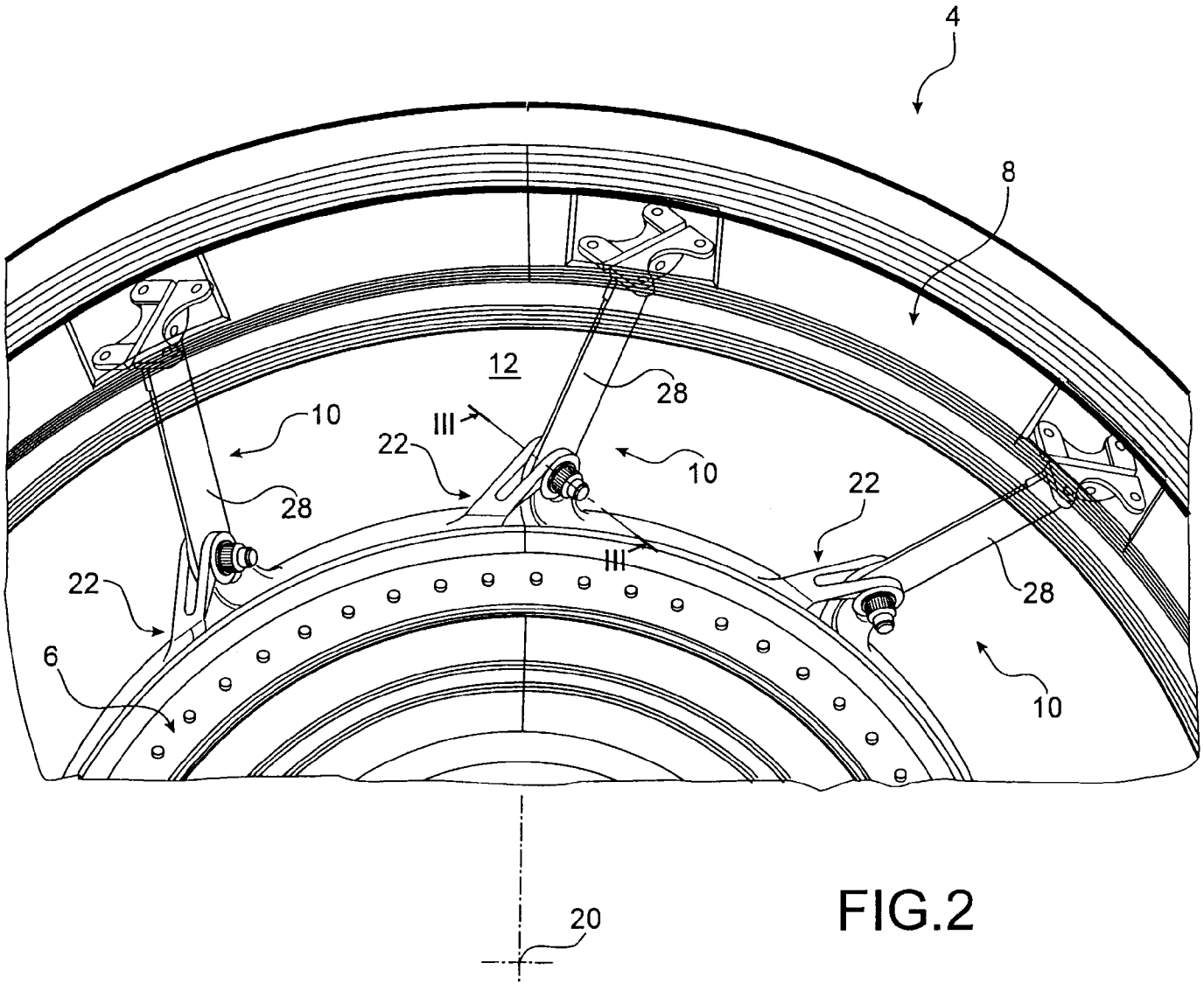
FIG. 2 shows a face-on part view of a stator joint belonging to the turbomachine shown in FIG. 1, this joint constituting part of the stator.

More specifically, with reference to FIG. 2, it is possible to see part of the stator joint 4 showing the plurality of joining devices 10 circumferentially spaced apart about the axis 20 of the turbomachine and of the assemblies 6, 8.

It is noted that one of the particular features of the joining devices 10 which will be detailed later is that each of them is provided with a clevis 22 set at a non-zero angle with respect to the axis 20, this angle at which the clevis is set being identical for each of the devises 22 produced. In other words and with reference to FIG. 2*a*, which is a view of any arbitrary clevis 22 from above, the clevis setting 24 is inclined by a setting angle A with respect to the axis 20, the magnitude of which angle may range between 0 and 90°. By way of indication, this clevis setting 24 corresponds to an axis parallel to each of the two clevis lugs 26*a*, 26*b* and therefore extends along the inter-lug space. As mentioned hereinabove, the diagram given in FIG. 2*a* is valid for all of the devises 22 fixedly attached to the first assembly 6 as an integral part of which they may optionally be formed. Thus, the setting angle A is of the same magnitude and in the same direction for all of the devises 22 which may then also be inclined in a radial direction, as clearly visible in FIGS. 2 and 2*a*.

As will be detailed later, the clevis 22 of a joining device 10 is designed to accept between its two lugs the internal radial end of a connecting member 28 in the form of an arm passing through the annular space 12, this member 28 having an external radial end fixedly attached to the second assembly 8, for example by screwed fittings.

One of the special features of the present invention is that it offers a design that allows each of the connecting members 28 to be introduced simultaneously into their associated clevis 22 by bringing the first and second assemblies to face each other followed by the application of a simple relative movement of the twisting or screwing type about the axis 10. To do this, a great separation between the lugs 26*a*, 26*b* of the clevis is provided in particular as will now be described with reference to FIG. 3.

This figure, which shows a device 10 in its assembled position, shows that the connecting member pierced with a through hole 30 at the internal radial end is housed between a first clevis lug 26*a* and a second clevis lug 26*b* which have a first clevis hole 32*a* and a second clevis hole 32*b* respectively.

In addition, the device 10 comprises a shear pin system 34 passing in succession through the first clevis hole 32*a*, the through hole 30 and the second clevis hole 32*b*. On the whole, this system 34 comprises a screw 36 which has a head 38 preferably equipped with a torque reacting system which performs a rotation-proofing function for the tightening of the associated nut system, and with a shank 40 which is threaded at its free end. The system 34 also comprises a clamping bushing 42 pushed onto the shank 40 and bearing against the screw head 38. Finally, the device also comprises a nut system 44 which may be in the form of a simple nut, screwed onto the threaded end 46 of the screw shank and bearing against the outer face of the second clevis lug 26*b*.

In this configuration, at the opposite end to the threaded end 46, the clamping bushing 42 of the shear pin system 36 constitutes a widened portion that passes right through the first clevis hole 32*a*, in particular meaning that the screw head 38 has to remain outside and some distance away from the clevis 22 against which it does not abut. In this respect, provision is preferably made for the diameter of the screw head 38 to be smaller than or equal to the outside diameter of the bushing which for its part corresponds more or less to the diameter of the first clevis hole 32*a*.

Thus, the bushing 42 that forms the widened portion therefore extends into the inter-lug space 48 in order at its end situated within this space 48 to constitute a shoulder 50 which therefore also lies between the first and second clevis lugs 26*a*, 26*b*.

This shoulder 50 butts against one of the faces of the connecting member 28, the other of its faces, the opposite one to the first, bearing against an inner face of the second lug 26*b*.

As a result, the connecting member 28 is held fixedly by nipping/friction some distance away from the first lug 26*a*, thanks to the pressure exerted by the shoulder 50.

By way of indication, provision is preferably made for the screw shank 40, the second clevis hole 32*b* and the interior surface of the clamping bushing 42 to have more or less the same diameter, it being possible for the diameter of the through hole 30 for its part to be slightly larger in order to accommodate any uncertainty as to the positioning prior to the introduction of the shear pin system 36 through the hole 30. Nonetheless, it should be noted that the shear pin system 36 is preferably designed to operate essentially in shear in collaboration with the through hole 30 and, as a secondary function, in friction through the contact between the opposing faces of the member 28 and the interior face of the lug 26*b* and the shoulder 50, respectively.

In the scenario depicted in FIG. 3, the screw shank 40 having a constant diameter between its free end and the end that is fixedly attached to the screw head 38, it is therefore obvious that the diameter of the second clevis hole 32*b* is smaller than that of the first clevis hole 32*a* through which the shear pin system 36 can slide freely upon assembly, along the axis 52 of the clevis holes 32*a*, 32*b*.

Naturally, in order to allow the joint to be assembled simply through a relative twisting movement between the first assembly 6 and the second assembly 8 about the axis 20, the person skilled in the art will be able to adjust the ratio E/e between the separation E between the first and second clevis lugs 26*a*, 26*b* in a direction of the shear pin system 36 that coincides with the axis 52 of the clevis holes and the thickness e of the connecting member 28 in that same direction 52. By way of indicative example, this ratio may be such that it satisfies the condition $1.3<E/e<2.5$.

Reference is now made to FIG. 4 which depicts a joining device according to a preferred second embodiment of the present invention. It has strong similarities with the first embodiment described hereinabove and, in this respect, it is emphasized that the elements which bear the same numerical references in the figures correspond to elements which are identical or similar.

Thus, it may be seen that the only difference lies in the fact that there is a shear pin system 36 made as a single piece, of which the head 38 bearing the screw shank 40 coincides with the widened portion 42 that forms the shoulder 50 and passes through the first clevis hole 32*a*. Here again, in the jointed state as depicted, there is no abutment between the first lug 26*a* and the screw head 38 passing through it.

Of course, various modifications can be made by those skilled in the art to the invention as just described merely by way of nonlimiting examples. In this respect, it may be possible to conceive of fitting the devises on the second assembly and the connecting members on the first assembly without departing from the scope of the invention.

The invention claimed is:

1. A joint in a turbomachine, comprising:

a first assembly which includes an inner wall member, an axis of said first assembly is the same as an axis of said turbomachine;

a second assembly which includes an outer wall member, an axis of said second assembly is the same as said axis of said turbomachine;

an annular space defined between said first assembly and said second assembly;

a clevis which is attached to said inner wall member of the first assembly, said clevis including a first lug with a first clevis hole and a second lug with a second clevis hole, said first lug includes a first side and a second side, opposite said first side, and said first clevis hole is substantially perpendicular to said first side and said second side of said first lug, said second lug includes a first side and a second side, opposite said first side, and said second clevis hole is substantially perpendicular to said first side and said second side of said second lug;

a connecting member which is fixedly attached to said outer wall member of the second assembly at a first end of said connecting member, said connecting member including a through hole disposed between said first lug and said second lug of said clevis at a second end of the connecting member, opposite said first end of said connecting member; and a shear pin which passes through each of said first clevis hole, second clevis hole and through hole, wherein said shear pin includes a first threaded end at a first end of the shear pin which threadably engages a nut, said nut abuts against said first side of said second clevis lug, wherein said shear pin includes, at a second end opposite the first threaded end, a bushing with a widened portion which passes through said first clevis hole and is fixed within said first clevis hole, said widened portion forms a shoulder disposed between said first and second clevis lugs, wherein said connecting member is disposed away from said first clevis lug along said shear pin, wherein a first side of said connecting member abuts against said shoulder and a second side of said connecting member, opposite said first side of said connecting member, abuts said second side of said second clevis lug, wherein said first side and said second side of said first clevis lug, said first side and said second side of said second clevis lug and said first side and said second side of said connecting member are substantially parallel to a clevis axis, and wherein said clevis axis is offset at an acute angle from said axis of said turbomachine.

2. The joint as claimed in claim 1, wherein a thickness e of said connecting member in an axial direction of the shear pin satisfies the condition $1.3<E/e<2.5$ where E corresponds to a separation between said first and second clevis lugs in the axial direction.

3. The joint device as claimed in claim 1, wherein said shear pin comprises a head and said bushing abuts said head at a first end of said bushing and forms said shoulder at a second end of said bushing opposite the first end of said bushing.

4. The joint as claimed in claim 3, wherein a diameter of said head is greater than an outer diameter of said bushing.

5. The joint as claimed in claim 1, wherein a diameter of said first clevis hole is larger than a diameter said second clevis hole.

6. The joint as claimed in claim 1, wherein said connecting member is an arm.

7. The joint as claimed in claim 1, wherein said annular space forms a portion of a primary duct for gases of said turbomachine.

8. The joint as claimed in claim 1, wherein the joint constitutes a portion of a stator of said turbomachine.

9. A turbomachine module which comprises at least one joint as claimed in claim 1 wherein the turbomachine module is a turbine or a compressor of a turbomachine.

10. The joint as claimed in claim 1, wherein the connecting member is fixedly attached to the second assembly by screwed fittings.

11. A joint in a turbomachine, comprising:

a first assembly which includes an inner wall member, an axis of said first assembly is the same as an axis of said turbomachine;

a second assembly which includes an outer wall member, an axis of said second assembly is the same as said axis of said turbomachine;

an annular space defined between said first assembly and said second assembly;

a clevis which is attached to said inner wall member of the first assembly, said clevis including a first lug with a first clevis hole and a second lug with a second clevis hole, said first lug includes a first side and a second side, opposite said first side, and said first clevis hole is substantially perpendicular to said first side and said second side of said first lug, said second lug includes a first side and a second side, opposite said first side, and said second clevis hole is substantially perpendicular to said first side and said second side of said second lug;

a connecting member which is fixedly attached to said outer wall member of the second assembly at a first end of said connecting member, said connecting member including a through hole disposed between said first lug and said second lug of said clevis at a second end of the connecting member, opposite said first end of said connecting member; and a shear pin which passes through each of said first clevis hole, second clevis hole and through hole, wherein said shear pin includes a first threaded end at a first end of the shear pin which threadably engages a nut, said nut abuts against said first side of said second clevis lug, wherein said shear pin includes, at a second end opposite the first threaded end, a screw head with a widened portion which passes through said first clevis hole and is fixed within said first clevis hole, said widened portion forms a shoulder disposed between said first and second clevis lugs, wherein said connecting member is disposed away from said first clevis lug along said shear pin, wherein a first side of said connecting member abuts against said shoulder and a second side of said connecting member, opposite said first side of said connecting member, abuts said second side of said second clevis lug, wherein said first side and said second side of said first clevis lug, said first side and said second side of said second clevis lug and said first side and said second side of said connecting member are substantially parallel to a clevis axis, and wherein said clevis axis is offset at an acute angle from said axis of said turbomachine.

* * * * *